US006489722B1

(12) United States Patent
Yoshida et al.

(10) Patent No.: US 6,489,722 B1
(45) Date of Patent: Dec. 3, 2002

(54) PLASMA DISPLAY PANEL

(75) Inventors: Kenji Yoshida, Kawasaki (JP); Tadayoshi Kosaka, Kawaski (JP); Takeo Masuda, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 222 days.

(21) Appl. No.: 09/704,537

(22) Filed: Nov. 3, 2000

(30) Foreign Application Priority Data

Mar. 22, 2000 (JP) ..... 2000-079428

(51) Int. Cl.[7] ..... H01J 17/49
(52) U.S. Cl. ..... 313/582; 313/491; 313/631
(58) Field of Search ..... 313/582, 491, 313/631

(56) References Cited

U.S. PATENT DOCUMENTS 6,392,344 B1 * 5/2002 Hong ..... 313/582
6,420,830 B1 * 7/2002 Youn ..... 313/583

* cited by examiner

*Primary Examiner*—Robert H. Kim
*Assistant Examiner*—Elizabeth Gemmell
(74) *Attorney, Agent, or Firm*—Staas & Halsey LLP

(57) ABSTRACT

A plasma display panel is provided in which a reliability of addressing is ensured, a flicker is reduced and the area that a cross talk can spread in the column direction is decreased so that a fluctuation of the display can be reduced. The plasma display panel has a first display electrode and a second display electrode that make an electrode pair for surface discharge. The first and the second display electrodes share one electrode for display of neighboring two rows. A partition is provided that divides a discharge gas space in the column direction only in the area where the first display electrode that is not used as a scanning electrode is positioned.

10 Claims, 11 Drawing Sheets

FIG. 11 *PRIOR ART*
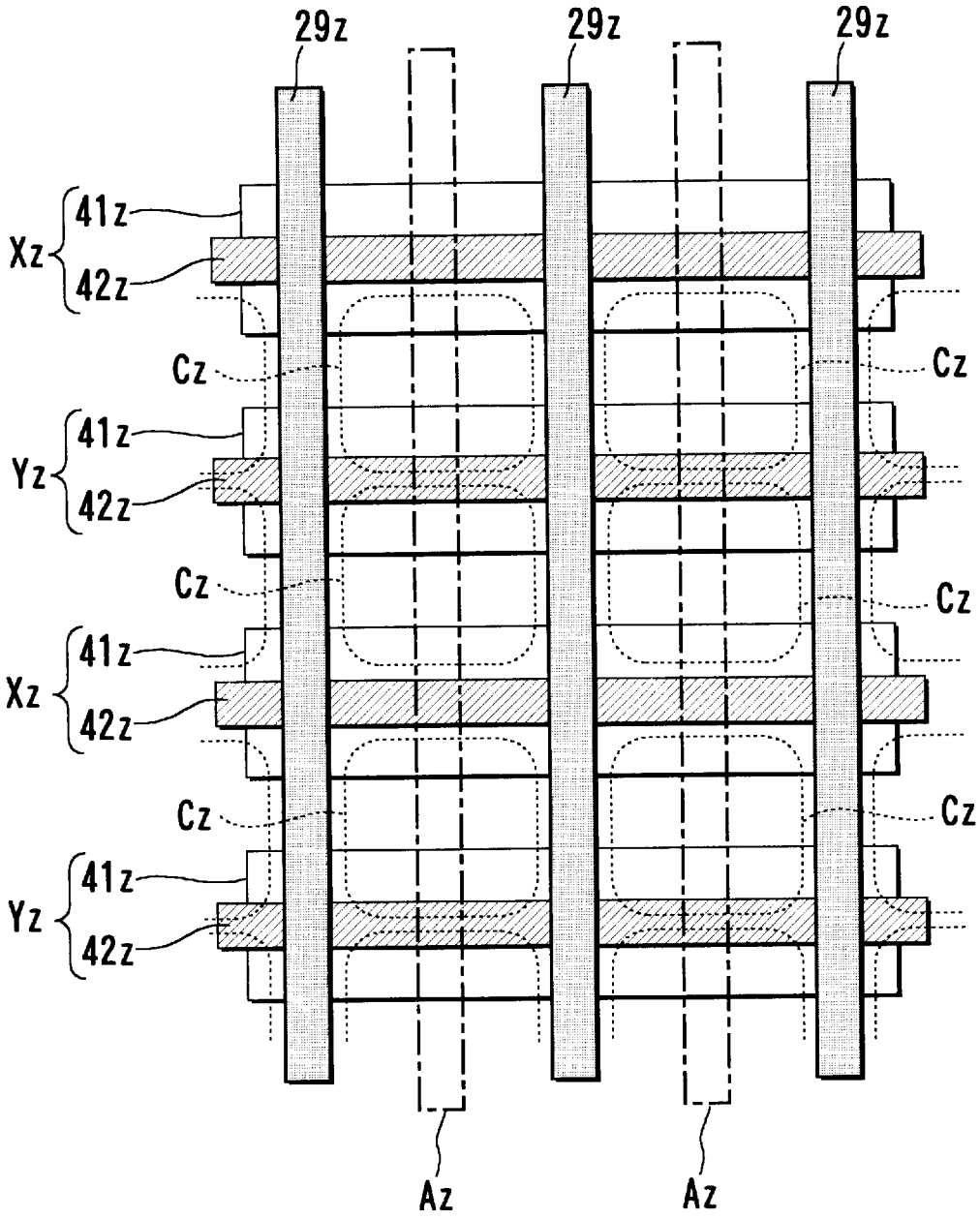

PLASMA DISPLAY PANEL

BACKGROUND OF THE INVENTION

1. Field of the Invention

The present invention relates to a surface discharge type plasma display panel (PDP).

An AC surface discharge type PDP is commercialized as a display device of a television set having a large screen. The surface discharge type has first and second display electrodes that are anodes and cathodes in display discharge for ensuring a luminance and are arranged in parallel on a front or a back substrate.

A "three-electrode structure" that has address electrodes arranged so as to cross display electrode pairs is well known as an electrode matrix structure of the surface discharge type PDP. One electrode of the display electrode pair (a second display electrode) is used as a scanning electrode for row selection, and the address discharge is generated between the scanning electrode and the address electrode so as to control wall charge for addressing in accordance with contents of display. After the addressing, by applying a sustaining voltage having alternating polarity to the display electrode pair, a surface discharge occurs along a surface of a substrate only at cells having a predetermined quantity of the wall charge.

2. Description of the Prior Art

Conventionally, a surface discharge type PDP is used in which N plus one display electrodes are arranged at a constant pitch in an interlace display, where N is the number of rows of a screen.

FIG. 11 is a plan view showing a cell structure of a conventional PDP.

The display electrode Xz is a laminate of a banding transparent conductive film 41*z* extending straightly in the row direction and a metal film 42*z* having a small width for augmenting the conductivity. The metal film 42*z* is arranged at the middle of the transparent conductive film 41*z* in the column direction. In the same way, the display electrode Yz includes a transparent conductive film 41*z* and a metal film 42*z* . Total N+1 of display electrodes Xz and Yz are arranged alternately, and the neighboring display electrodes Xz and Yz make an electrode pair for generating surface discharge, so as to form a row of screen. Each of the display electrodes Xz, Yz except both ends of the arrangement relates to display of two rows (an odd row and an even row), while the display electrodes Xz, Yz at the both ends relate to display of one row.

A discharge space is divided in each column by partitions 29*z*, and one column space that is a discharge space of one column is continuous over all rows. A structure of an area defined by neighboring partitions 29*z* and neighboring metal films 42*z* is a discharge cell (a display element) Cz. The address electrode Az is arranged at the middle of the column space.

An example of a driving method is as follows. In both address periods of an odd field and an even field, a scan pulse is applied to each display electrode Yz sequentially. Then, a potential of the odd display electrode Xz and a potential of the even display electrode Xz are switched complimentarily at each application of the scan pulse, so that an address discharge is generated between the display electrodes at the row for display (e.g., at an odd row in an odd field). In the display period following the address period, a sustaining pulse is applied alternately to the display electrodes Xz and Yz of the row that are used for the display, and a sustaining pulse is applied to the display electrode Xz of the row that is not used for the display (e.g., an even row in an odd field) in the same timing as the display electrode Yz. Namely, potential changes in the pair of display electrodes in the row that are not used for the display are in phase. Thus, discharge interference between an odd row and an even row can be reduced.

There is a problem of the conventional PDP in that since the column space is continuous over the entire length of the screen in the column direction, a cross talk of discharge can be generated in wide area over a few rows or a few tens of rows. In the structure having display electrodes arranged at a constant pitch, a displaying row and a non-displaying row are determined only by controlling their electrode potential. Therefore, the cross talk can occur easily compared with the structure in which a pair of display electrodes is arranged for each row so that an electrode gap between rows can be sufficiently wide. In order to eliminate the cross talk, a mesh pattern or a waffle pattern of partition can be provided for separating the cells, but it reduces an electrode area that contributes the discharge, resulting in reduction of display luminance. Since a main portion of the scanning electrode (Yz) is covered with the partition, an addressing potential may rise and a delay of discharge may occur. In addition, since the interlace display uses odd rows and even rows in time sharing for light emission, the separation of the cell will cause non-overlap of light emission areas of the odd row and the even row, resulting in a conspicuous flicker due to the time sharing light emission.

SUMMARY OF THE INVENTION

The object of the present invention is to ensure a reliability of addressing, to reduce a flicker and to decrease the area of cross talk in the column direction so that a display fluctuation can be reduced.

According to the present invention, the discharge gas space is divided by the unit of two cells aligned in the column direction. A scanning electrode that is one electrode of the display electrode pair is not used, but the other display electrode is used for dividing in the column direction. Since the dividing unit has an area of two cells, the light emission area of the odd row can overlap the light emission area of the even row in the column direction, so that the flicker cannot be conspicuous. Even if a cross talk of the discharge occurs, the fluctuation of the display is little since the cross talk is limited to the area of two cells or the multiples of the area. Since the discharge between the scanning electrode and the address electrode is not disturbed by the partition, a stable addressing can b e performed.

According to the first aspect of the present invention, a plasma display panel (PDP) comprises plural sets of first and second display electrodes making an electrode pair for surface discharge of each row, being arranged so that one electrode is shared by two neighboring rows for display, plural address electrodes crossing the electrode pair in each column, the second display electrode being a scanning electrode for row selection, and one or more partitions for dividing a discharge gas space in the column direction and only in a position within the area where the first display electrode is arranged.

According to the second aspect of the present invention, the address electrode has a first area opposing to the first display electrode and a second area opposing to the second display electrode, and the second area is larger than the first area.

According to the third aspect of the present invention, each of the first and the second display electrodes includes a transparent conductive film for ensuring an electrode area and a metal film for reducing a resistance, and the address electrode has a first area opposing to the metal film of the first display electrode and a second area opposing to the metal film of the second display electrode, the second area being larger than the first area.

According to the fourth aspect of the present invention, the portion of the partition that divides the discharge gas space in the column direction is arranged at the middle of the first display electrode in the column direction.

According to the fifth aspect of the present invention, the shape of the first display electrode is different from the shape of the second display electrode so that discharge characteristics of cells are made uniform.

According to the sixth aspect of the present invention, an effective area of the first display electrode is different from an effective area of the second display electrode so that discharge characteristics of cells are made uniform.

According to the seventh aspect of the present invention, the portion of the partition that divides the discharge gas space in the column direction is formed so as to have a gap that makes the discharge gas space continuous in the column direction.

According to the eighth aspect of the present invention, the first display electrode includes plural conductors separated from each other in the column direction within a screen area.

According to the ninth aspect of the present invention, each of the first and the second display electrode includes a transparent conductive film for ensuring an electrode area and a metal film for reducing a resistance, and the portion of the partition that divides the discharge gas space in the column direction is formed so as to overlap the metal film of the first display electrode.

According to the tenth aspect of the present invention, the PDP has three kinds of cells corresponding to three kinds of light emission colors, and an effective area of at least one of the first and the second display electrodes is adjusted for each light emission color, so that relative luminance of the each color can be adjusted.

BRIEF DESCRIPTION OF THE DRAWINGS

FIG. 11 is a plan view showing a cell structure of a conventional PDP.

DESCRIPTION OF THE PREFERRED EMBODIMENTS

Hereinafter, the present invention will be explained in detail with reference to embodiments and accompanied drawings.

Figure 1:
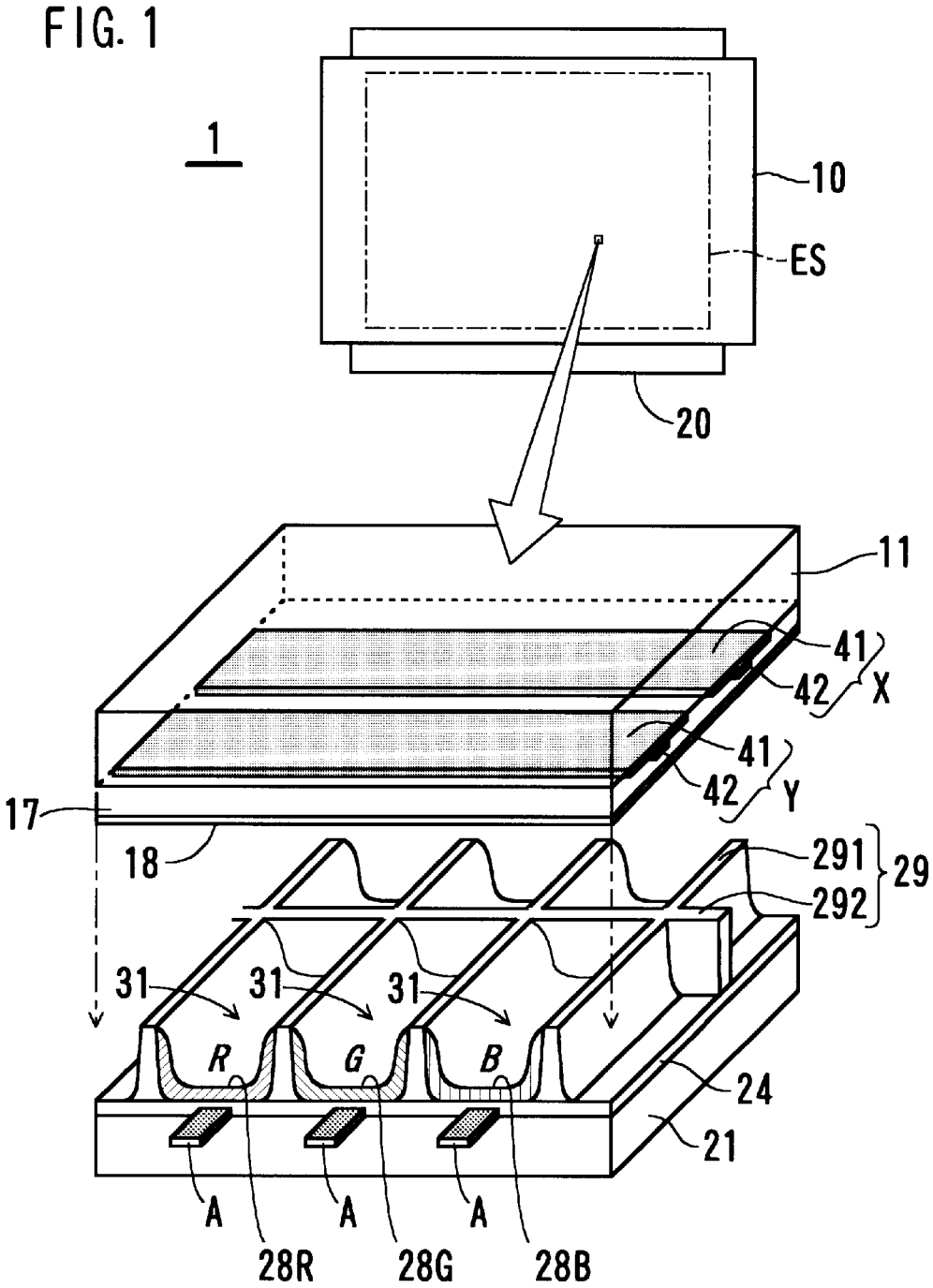
FIG. 1 shows a cell structure of a PDP according to a first embodiment of the present invention.
Figure 2:
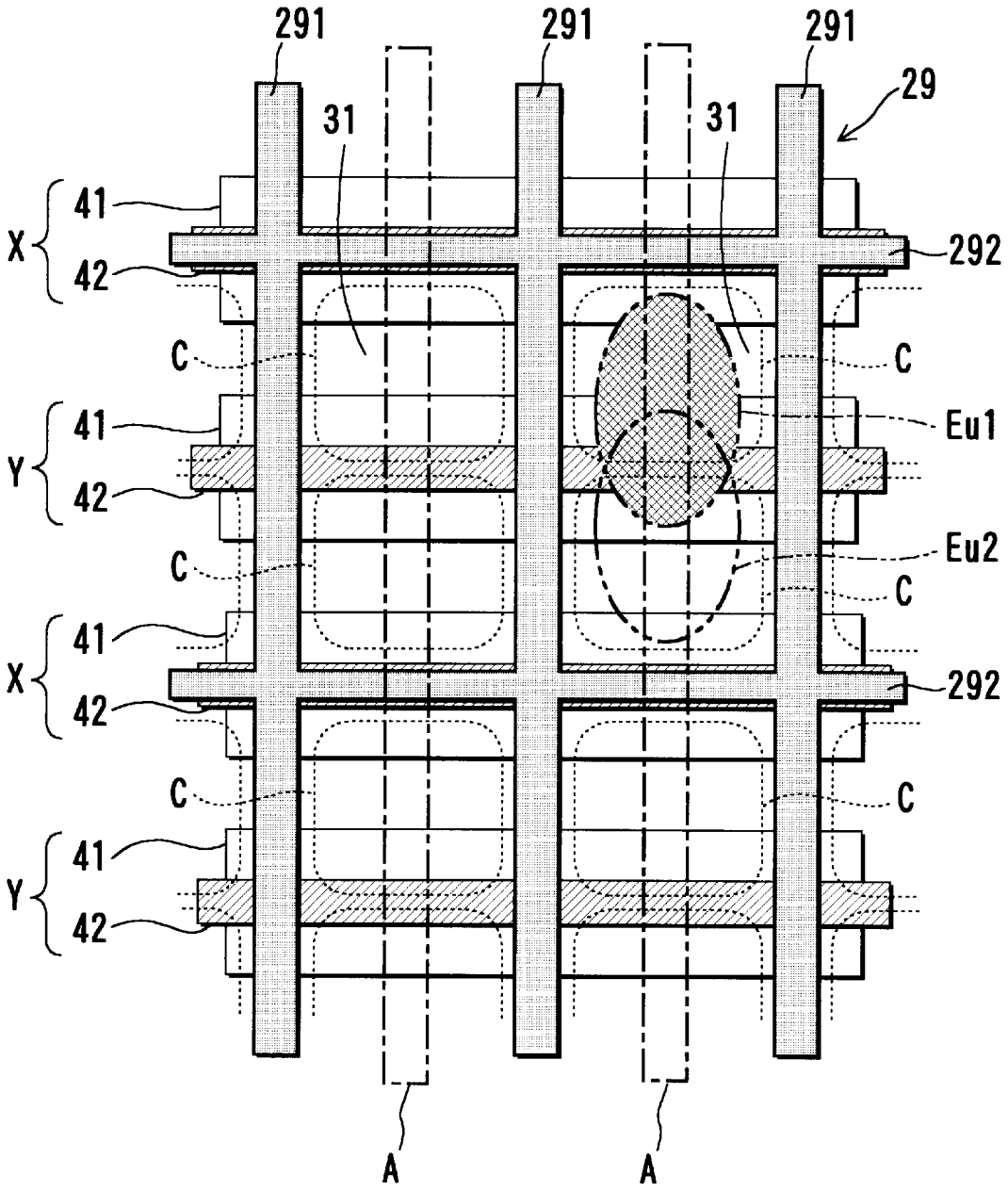
FIG. 2 is a plan view showing a partition pattern of the PDP according to the first embodiment.

FIG. 1 shows a cell structure of a plasma display panel (PDP) according to a first embodiment of the present invention. FIG. 2 is a plan view showing a partition pattern of the PDP according to the first embodiment.

The illustrated PDP 1 has a pair of substrate structures (including cell constructing elements on a substrate) 10, 20, and has a three-electrode surface discharge structure. In each cell of a screen (a display surface) ES, a pair of display electrodes X, Y and an address electrode A cross each other. The display electrodes X, Y are arranged on the inner surface of a glass substrate 11 of a front substrate structure 10. Each of the display electrodes X, Y has a transparent conductive film 41 that forms a surface discharge gap for each cell and a metal film (a bus conductor) 42 that is overlaid on the middle of the conductive film 41 in the column direction. The metal film 42 is drawn out of the screen ES, so as to connect with a drive circuit. The display electrodes X, Y are covered with a dielectric layer 17 having the thickness of approximately 30–50 $\mu$m, and the dielectric layer 17 is coated with a magnesia (MgO) as a protection film 18.

The address electrodes A are arranged on the inner surface of a glass substrate 21 of a back substrate structure 20, and are covered with a dielectric layer 24. On the dielectric layer 24, partitions 29 having the height of approximately 150 $\mu$m for defining a discharge gas space 31 of two cells in accordance with the present invention. The partition 29 includes a portion for dividing the discharge gas space to columns (hereinafter, referred to as a vertical portion) 291 and a portion for dividing the discharge gas space at an appropriate position in the column direction (hereinafter, referred to as a horizontal portion) 292. Three colors of fluorescent layers 28R, 28G and 28B for color display are arranged to as to cover the inner surface of the back side including the surface of the dielectric layer covering the address electrode A and the side face of the partition 29. The fluorescent layers 28R, 28G and 28B are excited locally by ultraviolet rays emitted by a discharge gas and emit light. Italic characters (R, G and B) in FIG. 1 indicate light emission colors of the fluorescent materials.

As shown in FIG. 2, a horizontal portion 292 of the partition 29 is formed only at the position of the display electrode X of the display electrodes X, Y that are arranged alternately so as to ensure the reliability of addressing. The display electrode X is an electrode that is not used for row selection. The division of the discharge gas space is not performed at the position of the display electrode Y that is used as a scanning electrode.

A vertical portion 291 of the partition 29 is arranged as a boundary wall between columns, and the partition pattern is a mesh pattern surrounding two cells C of rows in each column. Even if the discharge overspreads in a cell C excessively, the cross talk is localized in the discharge gas space 31 of two cells. In addition, discharge areas (light emission areas having a predetermined intensity) Eu1, Eu2 of two cells C sharing discharge gas space 31 overlap each other. Thus, when two cells C are lighted alternately every field in an interlace display of two to one, the quality of display becomes close to that when one cell C is lighted continuously over plural fields. Namely, a flicker is not conspicuous. If the division by the unit of two cells is difficult in a practical micro machining technology because of high definition with micro cells, the discharge gas space can be divided by a unit of 2m cells such as four cells or six cells.

Figure 3A:
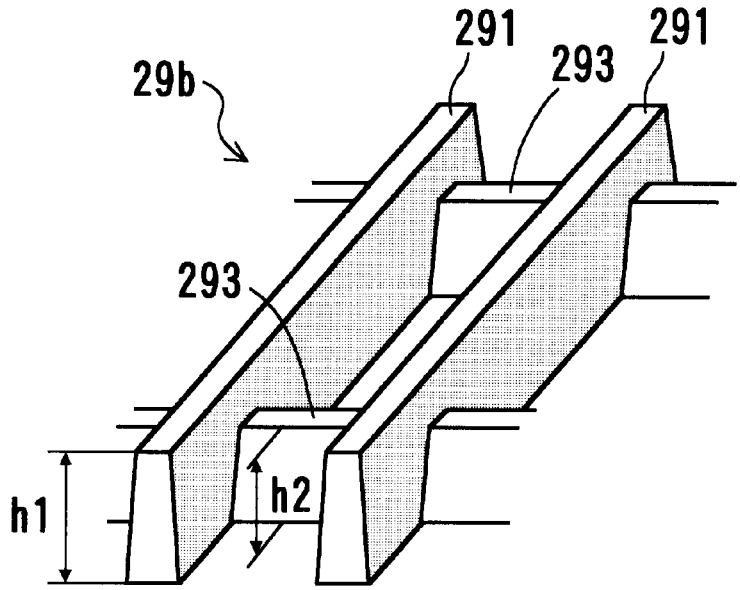
FIGS. 3A and 3B are perspective views showing a variation of the three-dimensional structure of the partition.
Figure 3B:
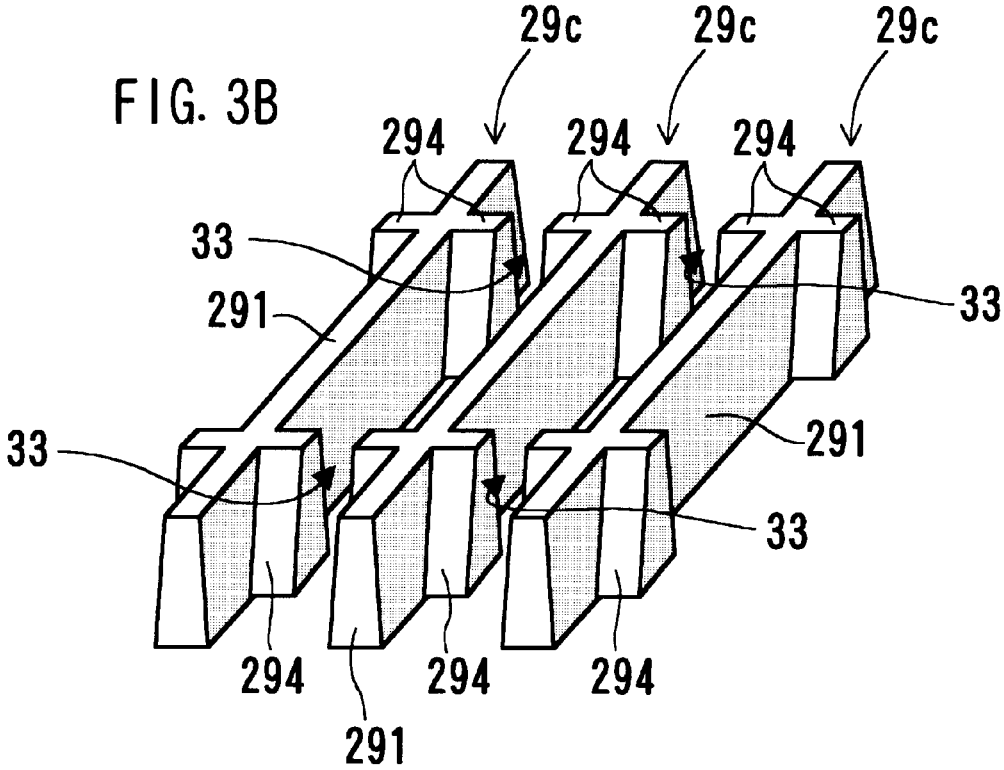

FIGS. 3A and 3B are perspective views showing a variation of the three-dimensional structure of the partition. In FIGS. 3A and 3B, each element corresponding to that of the above-mentioned example is denoted by the same reference numerals as in FIGS. 1 and 2. It is the same in the other following figures.

The partition 29*b* shown in FIG. 3A has the lower height h2 of the horizontal portion 293 that is parallel to the row direction than the height h1 of the vertical portion 291 that is parallel to the column direction. This height difference makes the discharge gas space communicate from one end to the other end in each column, so that the time necessary for exhausting air and injecting a gas can be shortened in the assembling step of PDP 1. An appropriate height h2 enables the horizontal portion 293 to suppress the cross talk sufficiently.

In the example of FIG. 3B, the discharge gas space is divided by plural partitions 29*c* that are arranged in the row direction with a slit 33. Each partition 29*c* includes the above-mentioned vertical portion 291 and a horizontal portion 294 extending from the vertical portion 291 in the row direction. The set of partitions 29*c* corresponds to the structure in which the portion 292 is cut off out of the partition 29 at the middle of the column as shown in FIG. 2. The slit 33 makes the discharge gas space communicate in each column.

Figure 4:
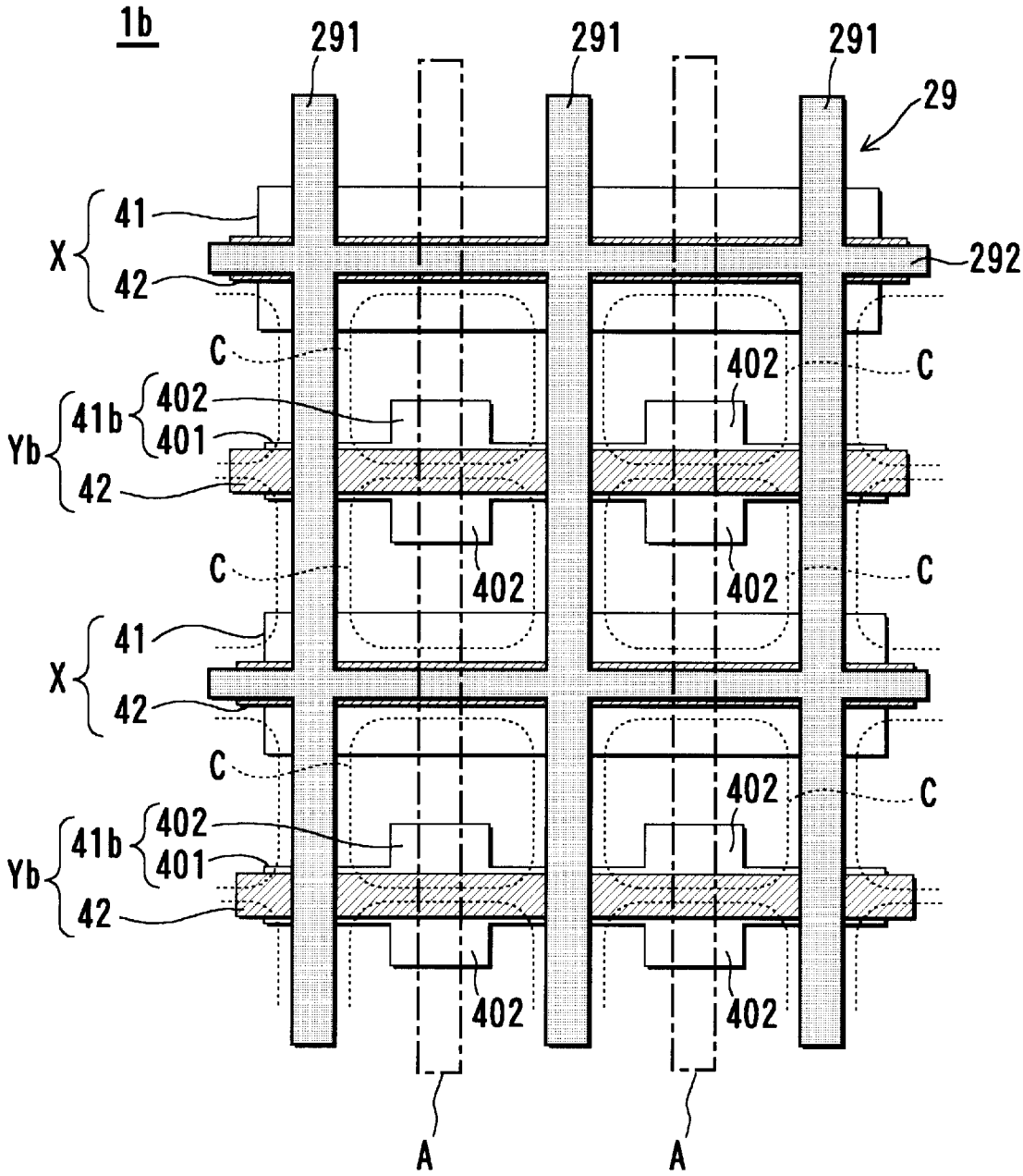
FIG. 4 is a plan view showing a first variation of the display electrode shape.

FIG. 4 is a plan view showing a first variation of the display electrode shape.

A PDP 1*b* in FIG. 4 has a display electrode Yb that is used for a scanning electrode, which includes a transparent conductive film 41*b* of a tooth-like shape extending over the entire length of the row and a linear banding metal film 42. The transparent conductive film 41*b* includes a protruding portion 402 defining a discharge portion of each column and a base portion 401 connecting the protruding portions 402. This structure can equalize the effective electrode areas of the display electrode X and the display electrode Yb by setting the size of the protruding portion 402. If the electrode areas are equal, the display discharge with the display electrode X as an anode has the same discharge condition as the display discharge with the display electrode Yb as an anode, so that more stable display can be realized. In addition, since the banding display electrode Yb is thick at the middle of each column and is thin at both ends, an average distance between the display electrode X and the display electrode Yb becomes larger than the case of a constant width of the banding shape, so that a capacitance between the electrodes is reduced. The display electrode Yb for scanning can have a structure in which the transparent conductive film is made in the shape of plural straps separated in each column, and these strap conductive films are connected by the linear banding metal film 42.

Figure 5:
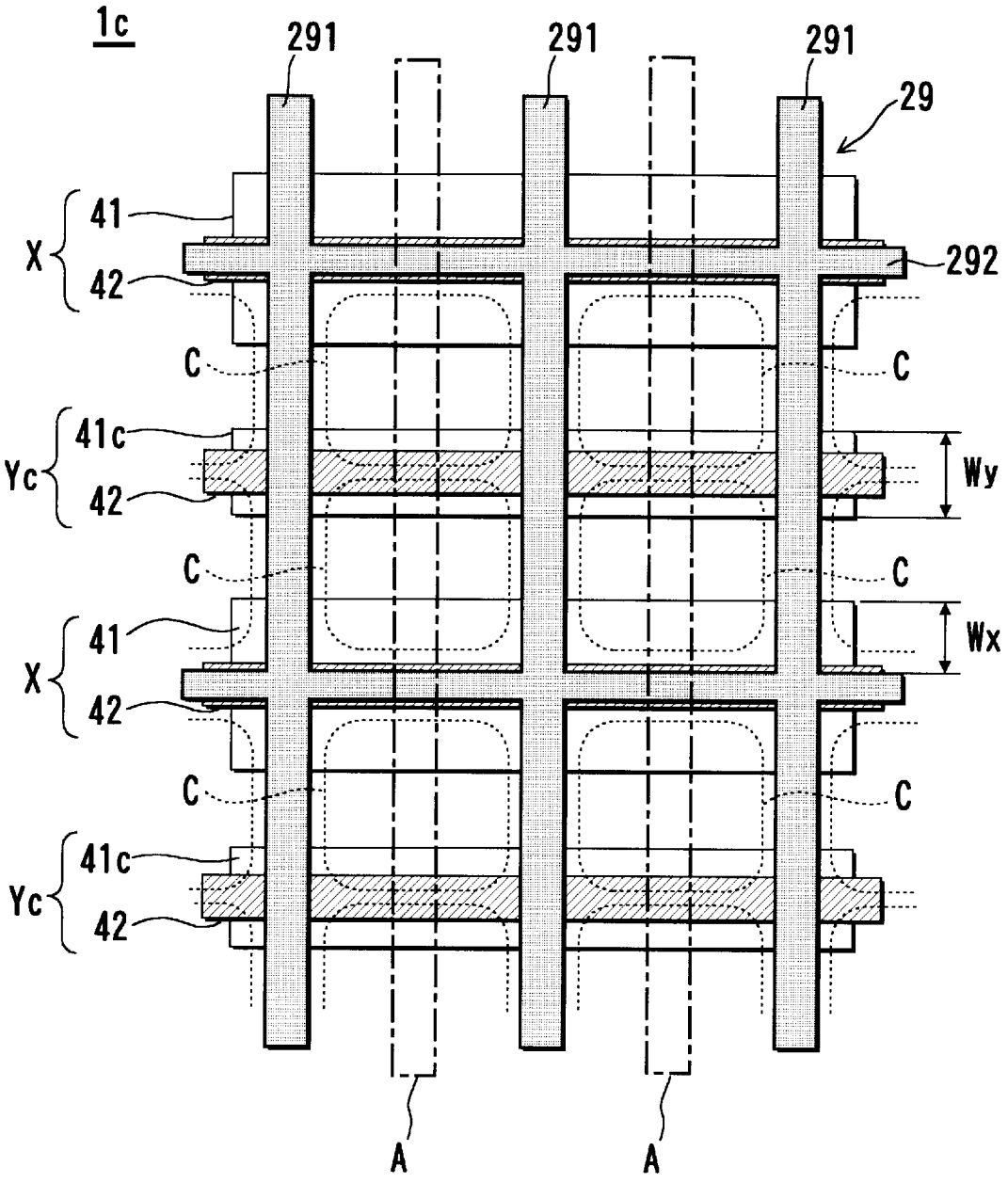
FIG. 5 is a plan view showing a second variation of the display electrode shape.

FIG. 5 is a plan view showing a second variation of the display electrode shape.

In a PDP 1*c* of FIG. 5, the width of the display electrode Yc that is used as a scanning electrode (i.e., the width of the transparent conductive film 41*c*) Wy and the width Wx of the display electrode X at the portion of one row display are selected so that the effective electrode areas of the display electrodes X, Yc becomes equal.

Figure 6:
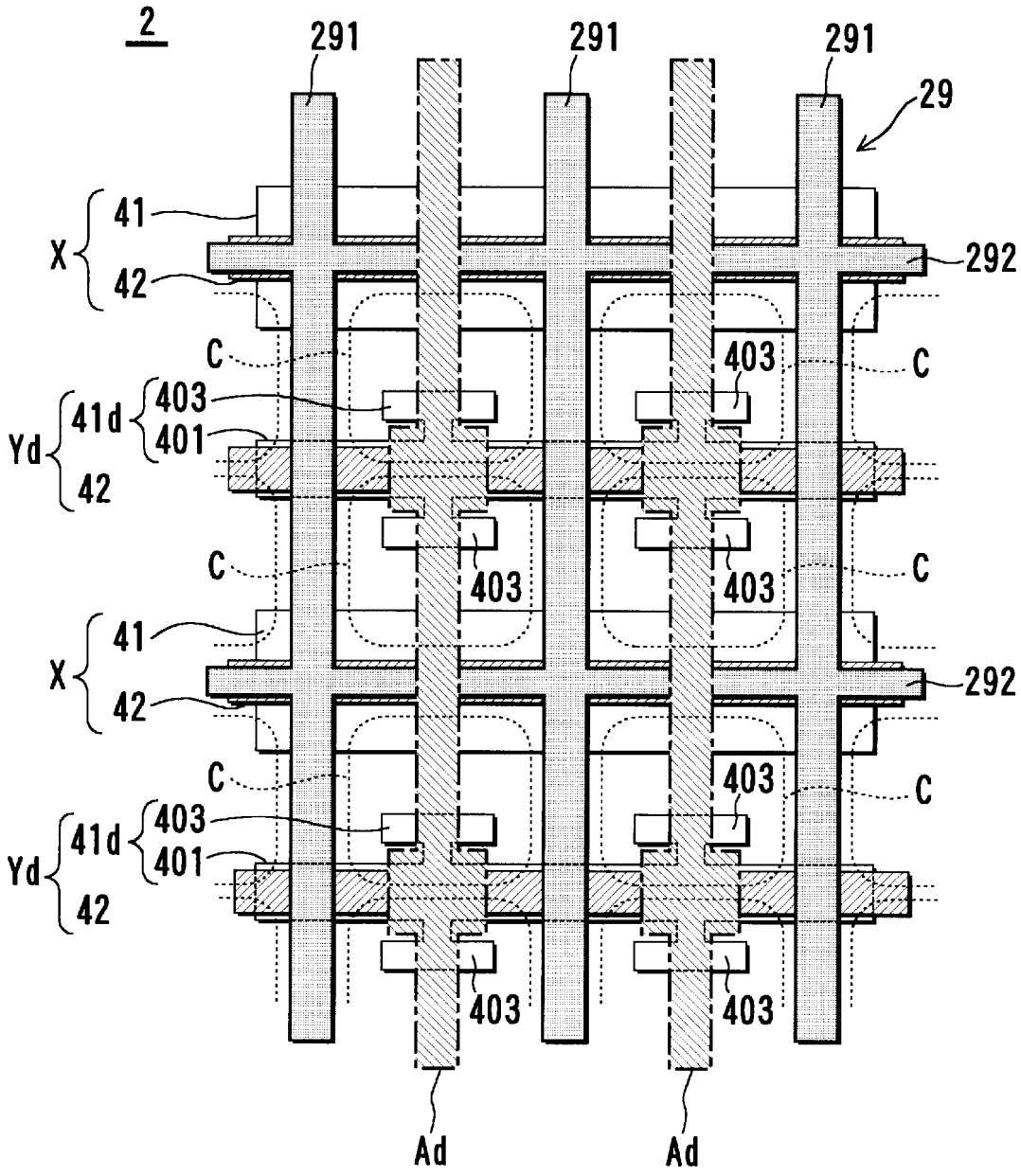
FIG. 6 is a plan view showing an electrode structure of a PDP according to the a embodiment of the present invention.

FIG. 6 is a plan view showing an electrode structure of a PDP according to a second embodiment of the present invention.

The PDP 2 of FIG. 6 has address electrodes Ad, each of which is patterned in such a banding shape that a portion crossing the display electrode Yd is thicker than other portions so as to ensure a larger margin of the addressing voltage. Enlarging the opposing area between the display electrode Yd and the address electrode Ad can increase the probability of addressing discharge, so that the address discharge can be generated easily. In contrast, it is desirable that the opposing area between the display electrode X and the address electrode Ad is as small as possible for reducing a capacitance.

The display electrode Yd includes a transparent conductive film 41*d* of a tooth-like shape extending over the entire length of the row and a linear banding metal film 42. The transparent conductive film 41*d* includes a linear banding base portion 401 and a protruding portion 403 that defines a discharge portion of each column. Each protruding portion 403 is patterned so as to cope from the base portion 401 in T-shape.

The illustrated shape of the transparent conductive film 41*d* is effective for reducing a discharge current and for suppressing a cross talk.

Figure 7:
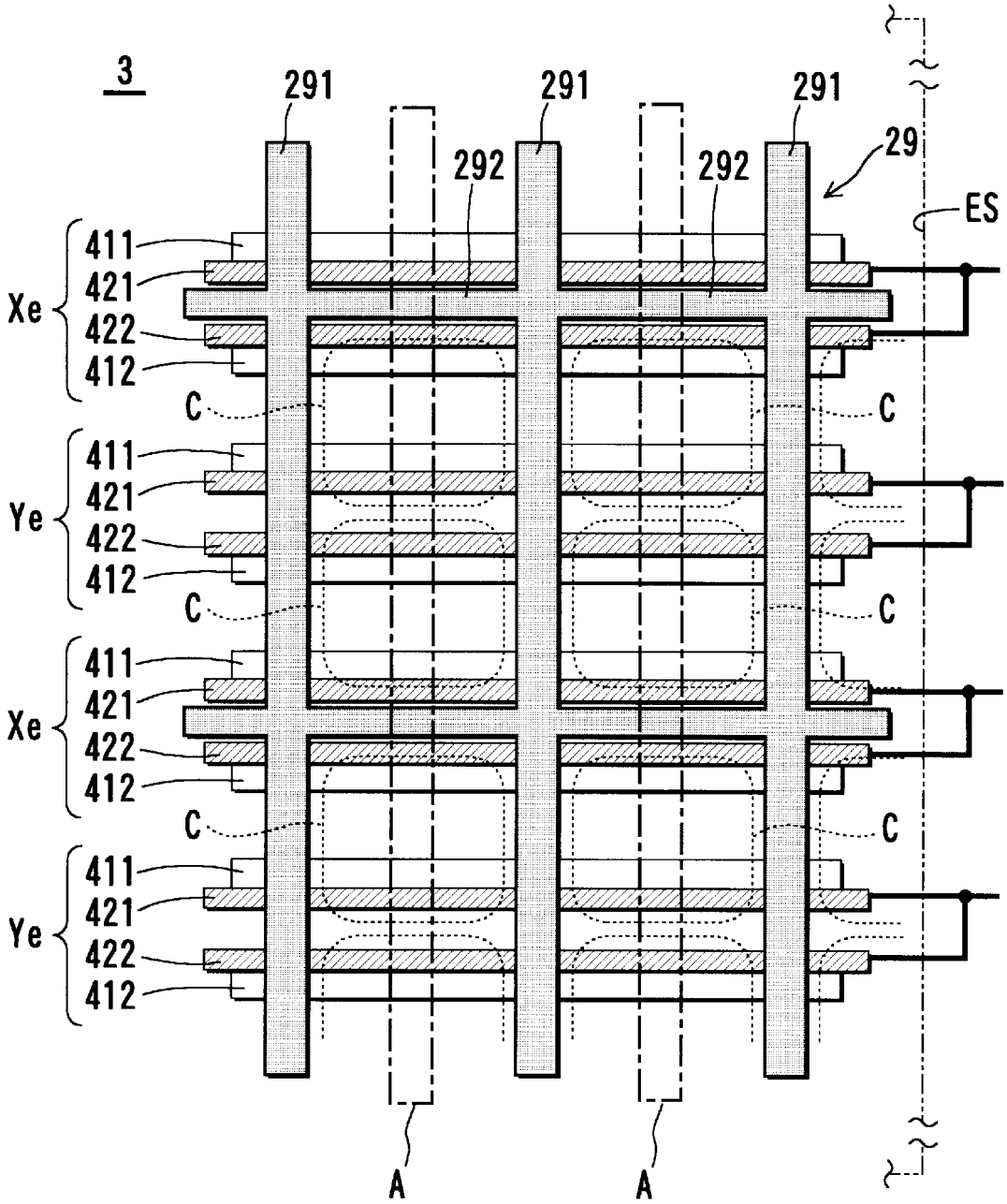
FIG. 7 is a plan view showing an electrode structure of a PDP according to a third embodiment of the present invention.

FIG. 7 is a plan view showing an electrode structure of a PDP according to a third embodiment of the present invention.

The PDP 3 has display electrodes Xe, Ye made of a pair of conductors separated in the column direction. One of the conductors includes a transparent conductive film 411 and a metal film 421. The other conductor includes a transparent conductive film 412 and a metal film 422. In each of the display electrodes Xe, Ye, the metal film 421 and the metal film 422 are connected to each other in the outside of the screen ES and can be regarded as a unit of conductor.

The display electrode Ye is divided in the column direction so that the two cells C that are surrounded by the partition 29 hardly generate a cross talk. In addition, the display electrode Xe is divided in the column direction so that the portion of the partition 29 that is surrounded by the horizontal portion 292 and does not contribute the discharge does not have the display electrode Xe. The opposing area between the display electrode Xe and the address electrode A is decreased by the gap so that the capacitance can decrease. However, the portion that does not contribute to the discharge is sandwiched by a pair of conductors that constitute the display electrode Xe and is a part of the area in which the display electrode Xe is positioned. Namely, the area in which the display electrode is positioned means an area from one end to the other end of the display electrode in the column direction.

Figure 8:
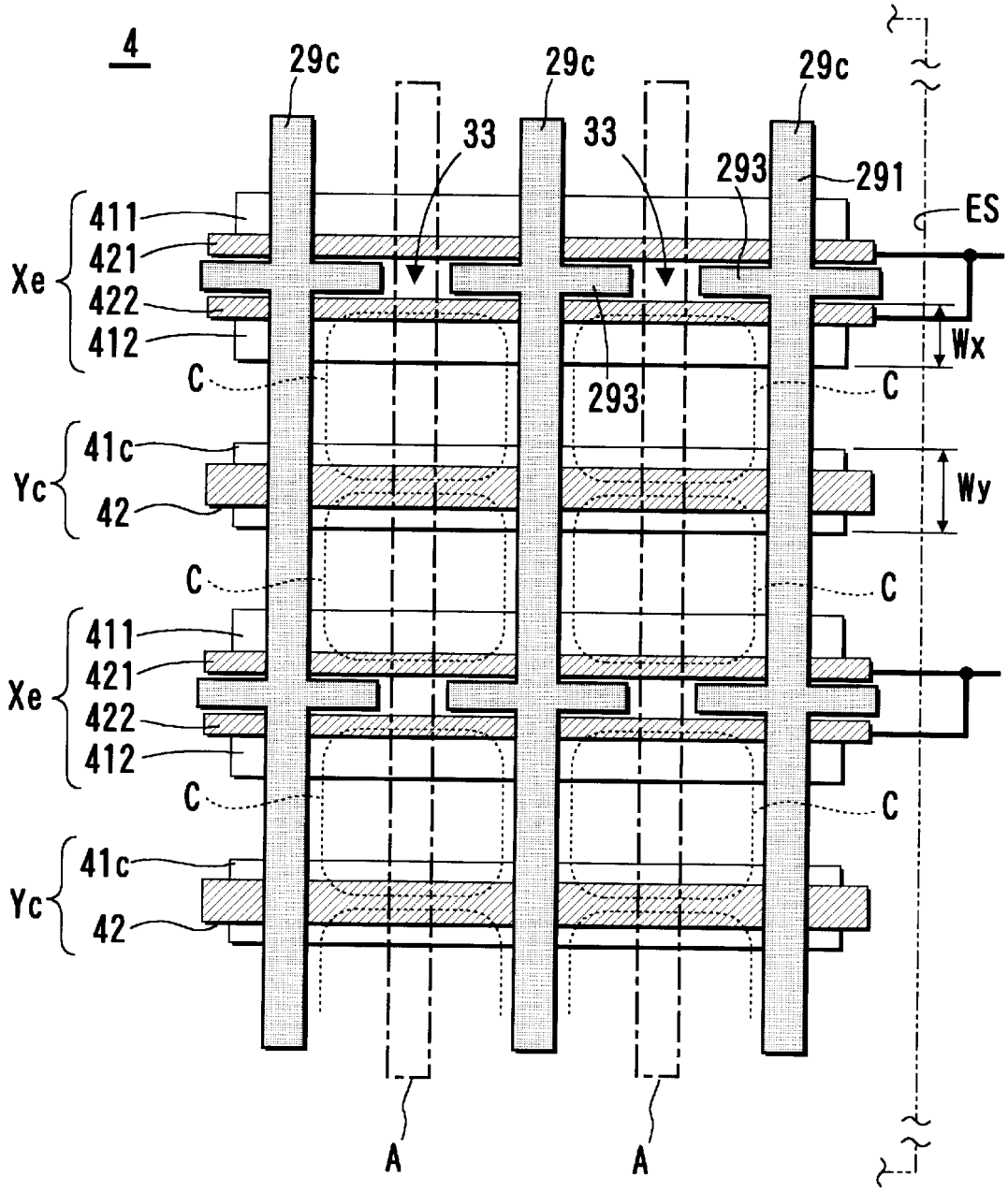
FIG. 8 is a plan view showing an electrode structure of a PDP according to a fourth embodiment of the present invention.

FIG. 8 is a plan view showing an electrode structure of a PDP according to a fourth embodiment of the present invention.

In the PDP 4, the display electrode Xe of the display electrodes Xe, Yc is divided into two in the column direction, and the size of the display electrode Yc is the same as the example shown in FIG. 5. The discharge gas space is divided with the partition 29*c* explained with reference to FIG. 3B. A slit 33 that enhances air permeability in the column direction also makes a cross talk easy to occur over the display electrode Xe. In PDP 4, the display electrode Xe is divided, and an electrode gap is provided between rows, so that the cross talk can be localized in the area of two cells and the air permeability can be enhanced.

Figure 9:
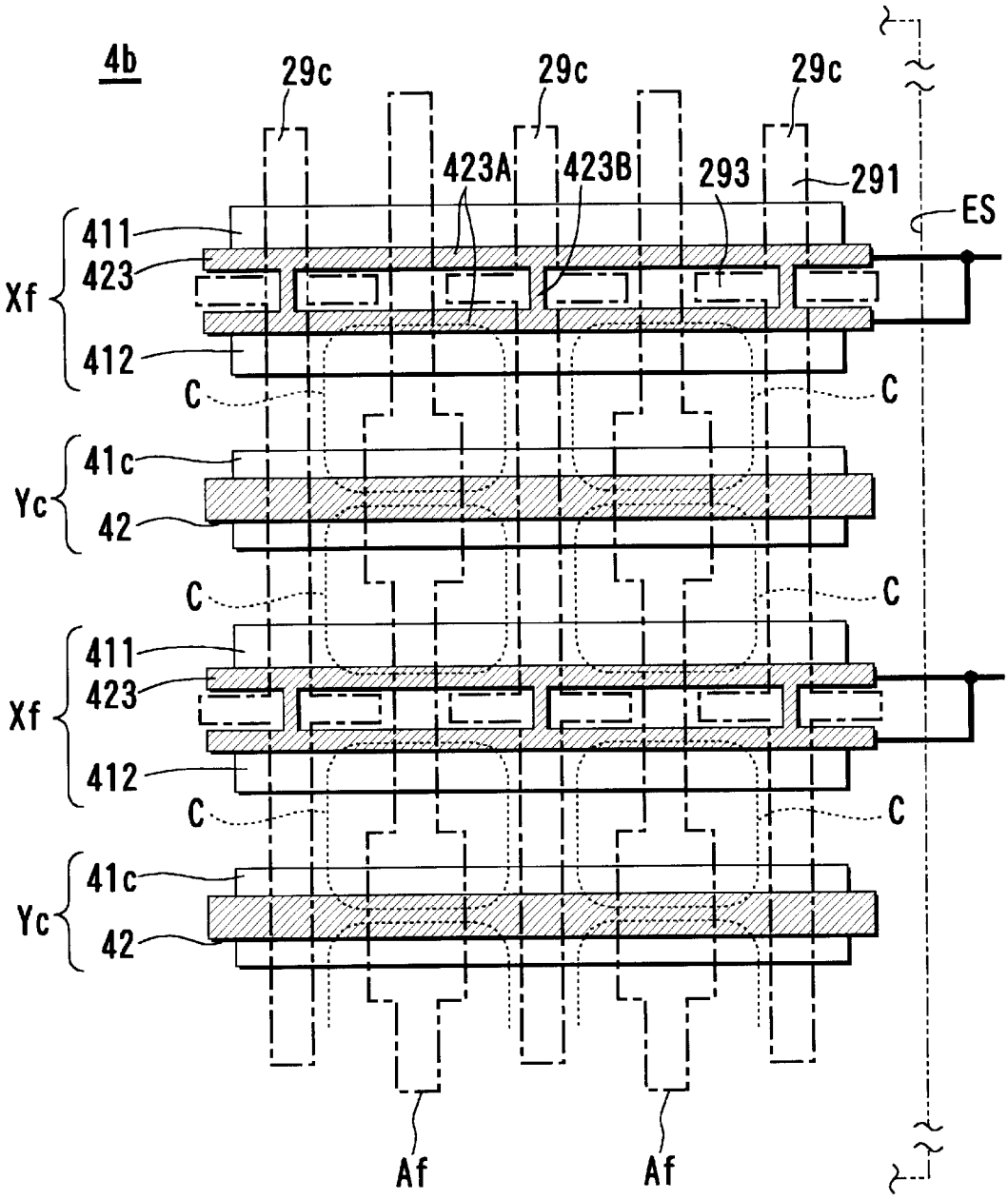
FIG. 9 is a plan view showing a variation of the electrode structure of the PDP in the fourth embodiment.

FIG. 9 is a plan view showing a variation of the electrode structure of the PDP in the fourth embodiment.

In the PDP 4*b*, the display electrode Xf includes a pair of transparent conductive films 411, 412 that are separated in the column direction and a ladder-like metal film 423. The metal film 423 includes a portion 423A corresponding to a pair of metal films 421, 422 shown in FIG. 8 and a portion 423B that connects the portion 423A at the position overlapping the partition 29*c*. The portion 423B decreases the probability of destroying the function of the metal film 423 due to a break at the portion 423A. The discharge cannot spread along the portion 423B that is overlapped by the partition 29*c*.

In the PDP 4*b*, the address electrode Af is patterned in such a banding shape that a portion crossing the display electrode Y that includes the metal film 42 and the transparent conductive film 41 is thick. The opposing area between the display electrode Y and the address electrode Af is larger than the opposing area between the display electrode Xf and the address electrode Af.

Figure 10:
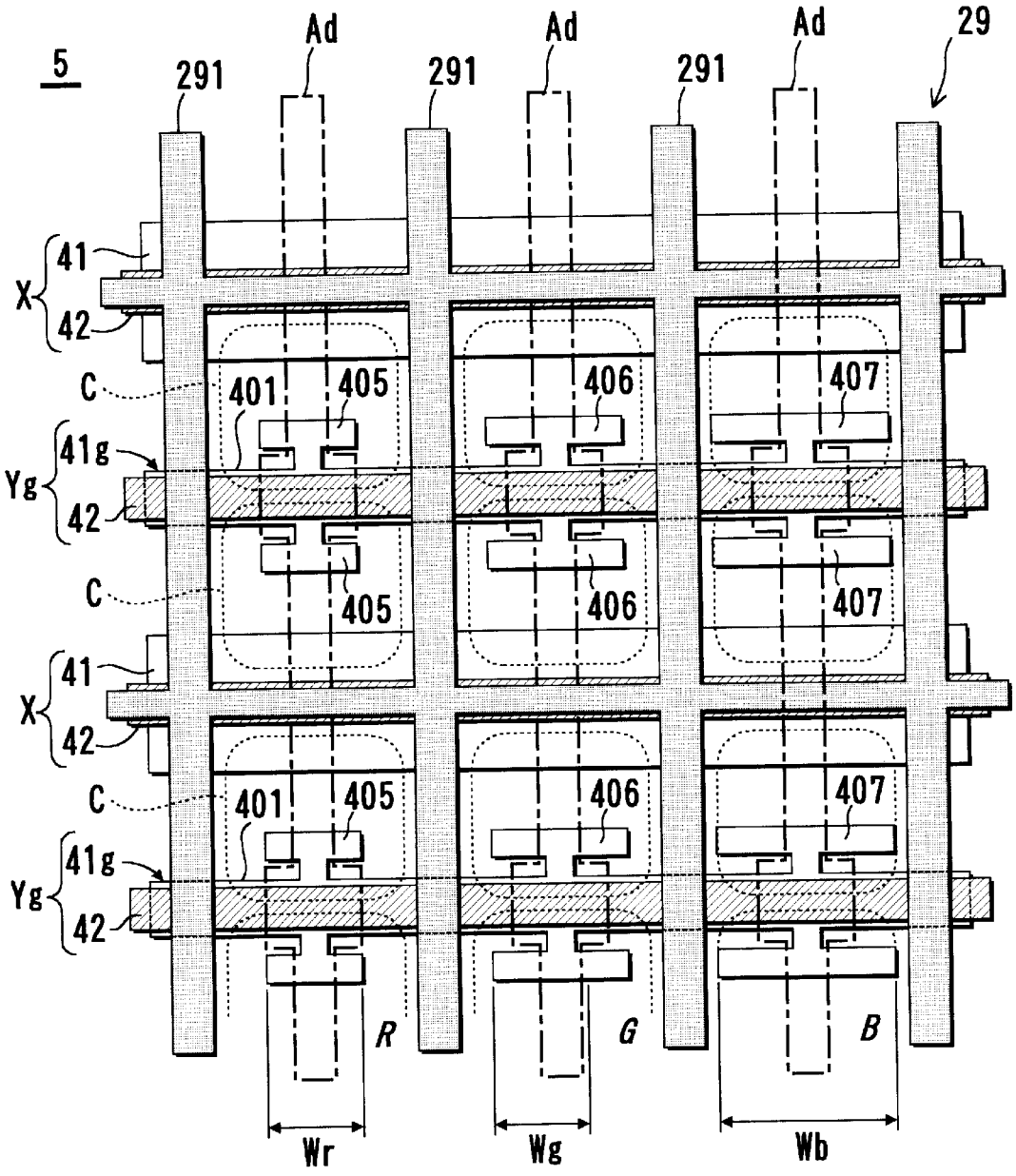
FIG. 10 is a plan view showing an electrode structure of a PDP according to a fifth embodiment of the present invention.

FIG. 10 is a plan view showing an electrode structure of a PDP according to a fifth embodiment of the present invention.

In the PDP 5 of FIG. 10, the display electrode Yg includes a transparent conductive film 41*g* having a tooth-like pattern extending over the entire length of the row and a linear banding metal film 42. The transparent conductive film 41*g* includes a linear banding base portion 401 and protruding portions 405, 406, 407 defining the discharge portion in each column. Each of the protruding portions 405, 406, 407 is patterned so as to cope from the base portion 401 in T-shape. However, differently from the example of FIG. 6, the areas of protruding portions 405, 406, 407 are optimized in accordance with the light emission color of the corresponding column, so that the white balance of the color display can be optimized. In the illustrated example, the width Wr of the protruding portion 405 in the column whose light emission color is red, the width Wg of the protruding portion 406 in the column whose light emission color is green, and the width Wb of the protruding portion 407 in the column whose light emission color is blue have the relationship of $Wr<Wg<Wb$.

The present invention can be embodied by combining the examples concerning the partition pattern, the display electrode shape and the address electrode shape without being limited to the above-mentioned examples. In addition, the display electrode can be a metal electrode having a mesh shape instead of using the transparent conductive film.

According to the present invention, the reliability of addressing can be ensured and the flicker can be reduced. In addition, the area that the cross talk can spread in the column direction can be decreased so that a fluctuation of the display can be reduced.

According to another aspect of the present invention, the margin of the addressing voltage can be enlarged.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A plasma display panel comprising:

plural sets of first and second display electrodes making an electrode pair for surface discharge of each row, being arranged so that one electrode is shared by two neighboring rows for display;

plural address electrodes crossing the electrode pair in each column;

the second display electrode being a scanning electrode for row selection; and one or more partitions for dividing a discharge gas space in the column direction and only in a position within the area where the first display electrode is arranged.

2. The plasma display panel according to claim 1, wherein the address electrode has a first area opposing to the first display electrode and a second area opposing to the second display electrode, and the second area is larger than the first area.

3. The plasma display panel according to claim 1, wherein each of the first and the second display electrodes includes a transparent conductive film for ensuring an electrode area and a metal film for reducing a resistance, and the address electrode has a first area opposing to the metal film of the first display electrode and a second area opposing to the metal film of the second display electrode, the second area being larger than the first area.

4. The plasma display panel according to claim 1, wherein the portion of the partition that divides the discharge gas space in the column direction is arranged at the middle of the first display electrode in the column direction.

5. The plasma display panel according to claim 1, wherein the shape of the first display electrode is different from the shape of the second display electrode so that discharge characteristics of cells are made uniform.

6. The plasma display panel according to claim 1, wherein an effective area of the first display electrode is different from an effective area of the second display electrode so that discharge characteristics of cells are made uniform.

7. The plasma display panel according to claim 1, wherein the portion of the partition that divides the discharge gas space in the column direction is formed so as to have a gap that makes the discharge gas space continuous in the column direction.

8. The plasma display panel according to claim 1, wherein the first display electrode includes plural conductors separated from each other in the column direction within a screen area.

9. The plasma display panel according to claim 1, wherein each of the first and the second display electrode includes a transparent conductive film for ensuring an electrode area and a metal film for reducing a resistance, and the portion of the partition that divides the discharge gas space in the column direction is formed so as to overlap the metal film of the first display electrode.

10. The plasma display panel according to claim 1, having three kinds of cells corresponding to three kinds of light emission colors, wherein an effective area of at least one of the first and the second display electrodes is adjusted for each light emission color, so that relative luminance of the each color can be adjusted.

* * * * *